US005890968A

United States Patent [19]

Mingo

[11] Patent Number: 5,890,968

[45] Date of Patent: Apr. 6, 1999

[54] GOLF SWING TRAINING DEVICE

[76] Inventor: Michael L. Mingo, 16402 Taylor St., Omaha, Nebr. 68116

[21] Appl. No.: 14,147

[22] Filed: Jan. 27, 1998

[51] Int. Cl.[6] ..... A63B 69/36

[52] U.S. Cl. ..... 473/207; 473/212; 434/252

[58] Field of Search ..... 434/252; 473/207, 473/212, 215, 216; 2/115

[56] References Cited

U.S. PATENT DOCUMENTS

| | | | |
|---|---|---|---|
| 3,672,682 | 6/1972 | Yanagidaira | 473/276 |
| 4,422,643 | 12/1983 | Cushing | 473/215 |
| 4,637,612 | 1/1987 | Wilkins | 473/215 |
| 4,890,841 | 1/1990 | Brooks | 473/215 |
| 4,896,887 | 1/1990 | Cable | 473/212 |
| 5,040,798 | 8/1991 | Leitao | 473/215 |
| 5,269,528 | 12/1993 | McCardle, Jr. et al. | 434/252 X |
| 5,397,121 | 3/1995 | Gipson et al. | 472/215 |
| 5,451,060 | 9/1995 | Dalbo | 473/215 |
| 5,529,306 | 6/1996 | Staats et al. | 473/208 |
| 5,586,761 | 12/1996 | Brock et al. | 473/207 |
| 5,658,203 | 8/1997 | Shub | 473/205 |

*Primary Examiner*—Klen T. Nguyen

[57] ABSTRACT

A golf swing training device for guiding the shoulder turn of a golfer from the address position to the apex of the back swing, through the forward swing until contact with a ball, and follow-through. In a preferred embodiment it comprises: an elongated rigid the shaft (10). A plurality of first fastening sides of a fastening pair (20) are affixed to one side of the shaft (10). A plurality of second fastening sides of said fastening pair (30) are affixed to the front of a shirt like garment (40) along a horizontal axis running through the mid-sections of the garment's (40) shoulder areas and under the clavicle area. The shaft (10) is then connected to the garment (40) by the engagement of the first sides of the fastening pairs (20) to the second sides of the fastening pairs (30). A flat based marker (50) is located and affixed to a front area of each of the shoulder areas of the garment (40) above the attached shaft (10). It is an-aid to teach and condition a golfer's muscles with respect to shoulder alignment through the golfer's swing. It is a simple, safe, lightweight, convenient, and inexpensive device, useable for swings during on-the-course play. It is also very useful without a club for practicing quick drill type rotation and body balance exercises almost anywhere.

5 Claims, 2 Drawing Sheets

GOLF SWING TRAINING DEVICE

BACKGROUND

1. Field of Invention

This invention relates to golf swing training devices, specifically to such devices which are used for improving the swing of a golfer.

2. Description of Prior Art

In the golf swing, there is a perfect plane and path that a club must follow in order to hit a ball straight. Many inventors of golf swing training devices have tried to develop a way of perfecting the swing plane. A device for guiding the swing of a golfer from the address position to the apex of the back swing to the forward swing until contact with the ball.

Originally, many of these devices were made to restrict or stabilize a part of the golfer's body so as to coordinate the swing. The devices forced golfers to conform to the devices' physical restrictions, thus creating artificially produced swings. U.S. Pat. No. 4,890,841 to Brooks (1989) and U.S. Pat. No. 5,529,306 to Staats and Corder, Jr. (1995) disclose devices which can control a golfer's swing; however, these devices make for an unnatural swing. This problem was addressed and partially solved by the introduction of guide structures that do not constrain, but these had and still have significant problems.

U.S. Pat. No. 5,586,761 to Brock and Foster (1994) is a guide structure device that does not constrain, however, it is cumbersome and complex. The device is not portable and simple of structure, two factors that golfers want. U.S. Pat. No. 4,422,643 to Cushing (1983) and U.S. Pat. No. 5,269,528 to McCardle, Jr. (1992) are guiding structure devices that are portable and simple of structure, but have other problems. Cushing's device is rigid and awkward to use. McCardle's device requires a person to hold it with his or her hands, thus not allowing a person to swing a club while using the device.

Although visual swing aids do not restrict or constrain a golfer's body movements, they do not physically guide the golfer through his or her swing. A golfer must rely on visual cues rather than training muscle memory. Focusing on visual cues does not allow the golfer to keep his or her eyes on a ball, which is a basic tenant of a good golf swing. U.S. Pat. No. 5,397,121 to Gipson and Wilkerson (1993) is an example of such a device.

Lastly, alignment devices, such as U.S. Pat. No. 5,658,203 to Shub (1997), address visually aligning a person with a distant target when addressing a golf ball. They do not, however, address the motion and path of a golfer through his or her swing.

OBJECTS AND ADVANTAGES

Accordingly, several objects and advantages of my golf swing training device are:

(a) to provide a device which will guide a golfer through the correct swing path without physical restriction;

(b) to provide a device which is portable so as to be easily carried by a golfer on a round of golf, use on a driving range, or practice by the golfer wherever he or she wants;

(c) to provide a device which is simple in structure so as to facilitate easy usage;

(d) to provide a device which will allow a golfer the use of his or her hands so as to hold and swing a club;

(e) to provide a device which will teach and train a golfer's muscles the correct swing path so as to create muscle memory;

(f) to provide a device which will allow a golfer to focus and concentrate on a ball from the address position to the apex of the back swing and through the forward swing until contact with the ball;

(g) to provide a device which will focus on the basic motion of the swing, the shoulder turn;

Further objects and advantages of my golf swing training device will become apparent from a consideration of the drawings and ensuing description.

DRAWING FIGURES

Figure 1:
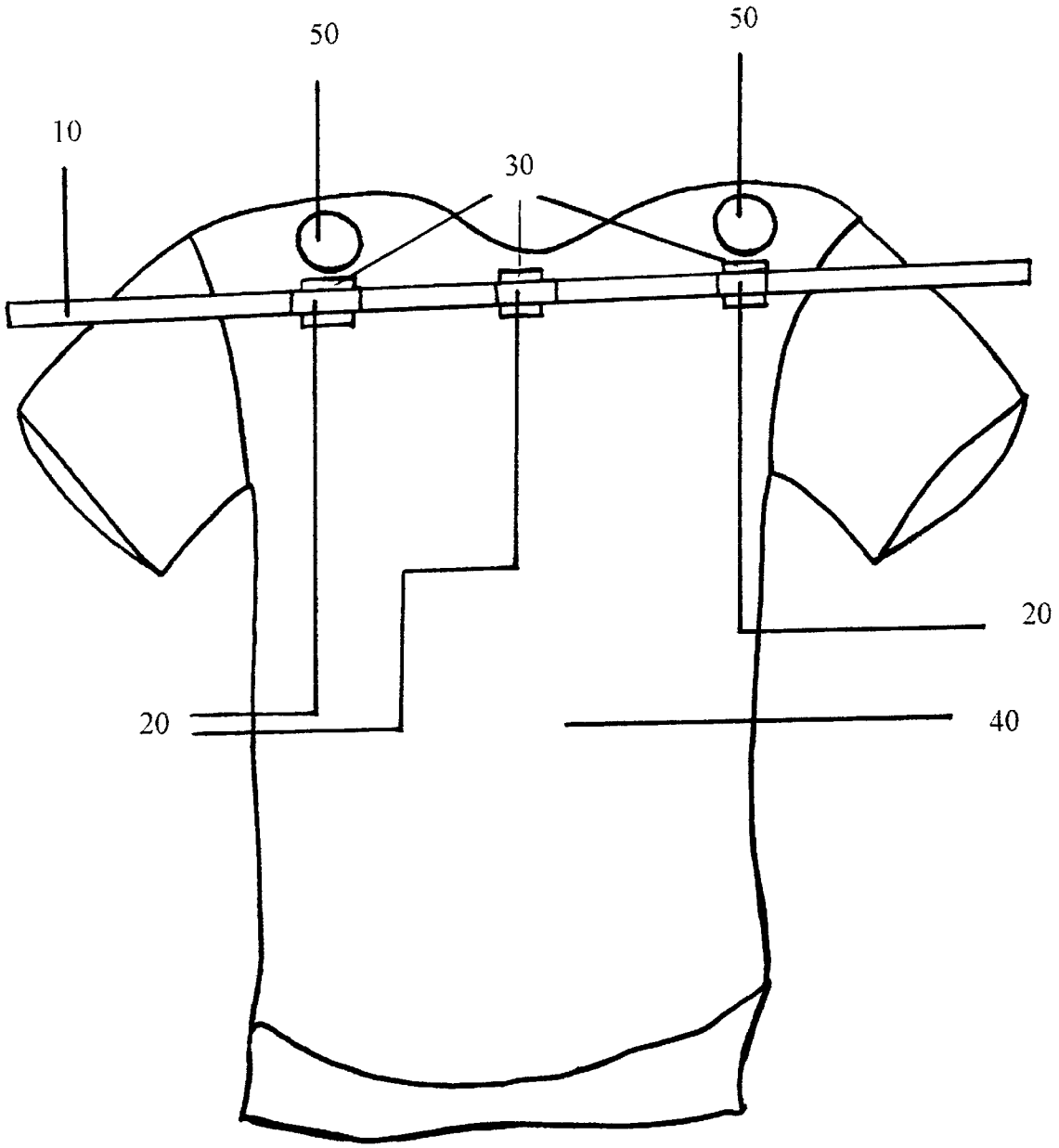
FIG. 1 shows a front view of my golf swing training device in detail.

REFERENCE NUMERALS IN DRAWINGS elongated rigid shaft
10 first fastening side of a fastening pair
30 second fastening side of a fastening pair
40 shirt like garment
50 flat based chin marker

SUMMARY

In accordance with the present invention a golf swing training device comprises a shirt like garment, an elongated rigid shaft mounted in a horizontal position across the front of the garment about the shoulder area and one flat based marker located and affixed to the front of each of the garment's shoulder areas.

DESCRIPTION

Figure 2:
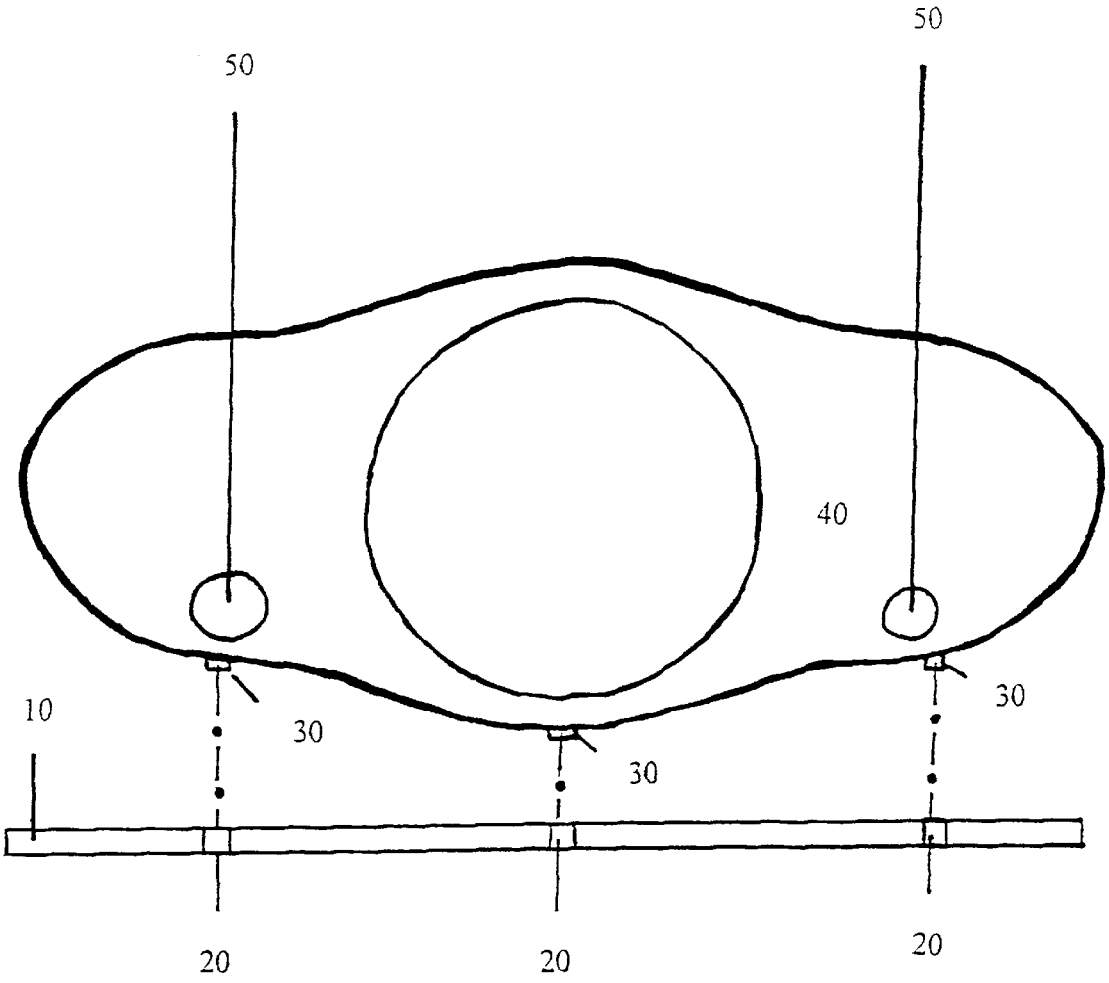
FIG. 2 is a top view in detail of my golf swing training device.

An embodiment of the device of the present invention is illustrated in FIG. 1 (front view) and FIG. 2 (top view). The device includes an elongated rigid shaft 10. A plurality of first fastening sides of a fastening pair 20 are affixed to one side of the shaft 10. A plurality of second fastening sides of the fastening pair 30 are affixed to the front of a shirt like garment 40 along a horizontal axis running through the mid-sections of the garment's 40 shoulder areas and under the clavicle area. The shaft 10 is then connected to the garment 40 by the engagement of the first side of the fastening pair 20 to the second side of the fastening pair 30. A flat based marker 50 is located and affixed to the front of each of the shoulder areas of the garment 40 above the attached shaft 10.

In the preferred embodiment, the shaft 10 is a shatter-proof plastic, has a solid cylinder shape, and is typically 1 cm in thickness and 90 cm in length.

The shirt like garment 40 has a neck opening and arm openings and is to be worn on the upper body of a person.

The first side of the fastening pair 20 consists of hooks and the second side of the fastening pair 30 consists of loops so as to form a hook and loop fastening pair. When pressed together and engaging one another, a substantial amount of force is required to separate them. The hook sides of the fastening pairs 20 and the loop sides of the fastening pairs 30 are square in shape and are approximately 2 cm×2 cm.

The hook sides of the fastening pairs 20 are affixed to the shaft 10 in positions approximately at 28 cm, 45 cm, and 62 cm. The positions of the loop sides of the fastening pairs 30 on the shirt like garment 40 correspond to the positions of the hook sides of the fastening pair 20 on the shaft 10. The hook fastening sides of the fastening pair 20 are affixed to the shaft 10 by virtue of an adhesive. The loop fastening sides of the fastening pair 30 are affixed to the garment 40 by virtue of a sewing process.

The flat based markers 50 are heat transfer decals circular in shape and having a diameter of roughly 7 cm. The flat based markers 50 are located in the middle of an area defined by the shaft 10, a segment of the garment's 40 collar area, and a seam which joins a sleeve to the garment's 40 body. They are affixed to the garment 40 by virtue of a heat transfer process.

From the description above, a number of advantages of my golf swing training device become evident:

(a) the device is not physically restricting which allows for a natural swing.

(b) the device is portable, as well as being detachable, which allows for easy use on a course.

(c) the device is simple in structure and nature which allows for ease of instruction.

(d) the device allows a person to use his or her hands to swing a club.

(e) the device allows a person to focus and concentrate on a ball while swinging a golf club.

(f) the device will teach a person the basic motion of the golf swing, the shoulder turn.

(g) the device will not interfere with a person's arms during a swing.

OPERATION—FIGS. 1,2

The manner of using the golf swing training device is simple. First, a golfer puts on the shirt like garment 40. Secondly, he or she fastens the elongated rigid shaft 10 to the shirt like garment 40 by matching up the hook side of the fastening pair 20 affixed to the elongated rigid shaft 10 to the loop side of a fastening pair 30 affixed to the shirt like garment 40.

Once this has occurred, the golfer addresses a golf ball. The golfer starts his or her swing by turning back, rotating his or her torso over a firm base and pushing his or her lead shoulder under his or her chin. The golfer's chin makes contact with a flat based marker 50 on the golfer's lead shoulder. An end of the shaft 10 moves into a position over a right-handed golfer's right foot or a left-handed golfer's left foot. This indicates that a full turn has been made. At the same time, the shaft 10 acting like a lever, due to its specific placement across the golfer's shoulders, guides the golfer's trailing shoulder into a proper position on the golfer's own unique swing plane. The shaft 10 is in a position parallel to the golfer's trail foot. Next, the person starts his or her downswing. The golfer's eyes focused on a golf ball and turning so the club and his or her body rotates 180 degrees while striking the golf ball. The golfer follows through making contact with his or her chin against a flat based marker 50 on the golfer's trail shoulder.

To remove the device, a person has only to exert enough force to pull the hook sides of the fastening pairs 20, which are affixed to the shaft 10, from the loop sides of the fastening pairs 30, which are affixed to the shirt like garment 40.

CONCLUSION, RAMIFICATIONS, AND SCOPE

Accordingly, the reader will see that the golf swing training device of this invention provides a non-restricting, portable, and simple device that can be used by persons of almost any age. Furthermore, the golf swing training device has the additional advantages in that (a) it allows all golfers to use their hands to hold and their arms to swing a club;

(b) it creates muscle memory in the golfer's body after repeated use;

(c) it permits a golfer to concentrate and focus on a golf ball;

(d) it teaches a golfer the basic motion of a good golf swing, the shoulder turn.

Although the description above contains many specifications, these should not be construed as limitations on the scope of the invention, but rather as an exemplification of one preferred embodiment thereof. Many other variations are possible.

One example is the shaft 10 can consist of any other material that can be repeatedly used without fracturing, such as polyethylene, polypropylene, vinyl, nylon, rubber, leather, various impregnated or laminated fibrous materials, various plasticized materials, wood, cardboard, paper, etc. Another example is that it can have other shapes such as triangular, trapezoidal, etc. The shaft 10 can have different dimensions to accommodate a person's size and stature. The shaft 10 can be made in any color.

The garment 40 can have other shapes such as a vest, robe, coat, etc. It can have different colors, styles and shapes. The garment 40 can be made out of almost any type of material .

The size, shape, and color of the hook sides of the fastening pair and loop sides of the fastener pairs can be changed without significant adjustments being made to the device. The fastening pairs can be eliminated if another way for mounting the shaft 10 with the garment 40 is used. For example, the elongated rigid shaft 10 can be attached to the shirt by sliding it through openings in the shirt like garment that would correspond to where the loop sides of the fastening pairs 30 would be located thus eliminating the hook and loop fasteners. Also, the shaft 10 could slide through a tunnel construction made from a material which is affixed to the garment 40 in the same relative horizontal position as the loop sides of the fastening pairs 30, thus eliminating the hook and loop fasteners once again.

The size, shape, and color of the flat based markers 50 can be changed without significant adjustments being made to the device. The markers 50 can be eliminated without significant changes being made to the device as well.

Accordingly, the scope of the invention should be determined not by the embodiment(s) illustrated, but by the appended claims and their legal equivalents.

I claim:

1. A golf swing training device comprising:

(a) a shirt like garment having a neck opening and arm openings to be worn on the upper body of a person;

(b) a flat based chin target affixed to a front shoulder area of each side of said shirt like garment's shoulder areas;

(c) an elongated rigid shaft having sufficient length to extend to or past the width of said person's shoulders;

(d) means for joining said elongated rigid shaft to the front of said shirt like garment in a horizontal orientation across said person's shoulders just under the clavicle area and under said flat based chin targets affixed to the front shoulder areas of said shirt like garment;

(e) whereby said person in combination with a golf club can practice golf swings with his or her shoulders properly positioned through the motion of a golf swing, controlling and coordinating the swing with his or her body rather than his or her arms.

2. The golf swing training device of claim 1 wherein said shirt like garment and said flat based chin targets have complementary coextensive engaging surfaces.

3. The golf swing training device of claim 1 wherein said flat based chin targets are detachably mounted to said shirt like garment.

4. The golf swing training device of claim 1 wherein said shirt like garment and said elongated shaft have complementary coextensive engaging surfaces.

5. The golf swing training device of claim 1 wherein said elongated rigid shaft is detachably mounted to said shirt like garment.

* * * * *